US006138417A

United States Patent [19]

Woodard et al.

[11] Patent Number: 6,138,417

[45] Date of Patent: Oct. 31, 2000

[54] ROOF STRUCTURE FOR ENCLOSURES FOR SWIMMING POOLS OR PATIOS AND THE LIKE HAVING REMOVABLE AND/OR STACKABLE ROOF PANELS

[75] Inventors: William M. Woodard, New Port Richey; Jeffery O. Bemis, Masarkytown, both of Fla.

[73] Assignee: Florida Enclosure Systems, Inc., Hudson, Fla.

[21] Appl. No.: 09/034,755

[22] Filed: Mar. 4, 1998

[51] Int. Cl.[7] ..... E04B 1/346; E04B 7/16

[52] U.S. Cl. ..... 52/64; 52/72; 52/200; 52/6; 160/222; 160/202; 49/127; 49/128; 49/125

[58] Field of Search ..... 52/64, 6, 200, 52/72; 160/222, 202, 223, 226; 49/127, 128, 125

[56] References Cited

U.S. PATENT DOCUMENTS

| | | | |
|---|---|---|---|
| 624,342 | 5/1899 | Kingsley | 52/200 |
| 1,446,188 | 2/1923 | Lang . | |
| 1,751,358 | 3/1930 | Rice et al. | 160/202 |
| 2,056,814 | 10/1936 | Winn | 52/72 |
| 2,094,801 | 10/1937 | Mass | 52/64 |
| 2,602,693 | 7/1952 | Murphy | 160/202 |
| 3,341,180 | 9/1967 | Dashio . | |
| 3,624,974 | 12/1971 | Waddington . | |
| 4,057,284 | 11/1977 | Blank . | |
| 4,528,785 | 7/1985 | deJager . | |
| 4,616,451 | 10/1986 | Glick | 49/125 |
| 4,641,479 | 2/1987 | Spurlock | 52/64 |
| 4,683,686 | 8/1987 | Ozdemir | 52/64 |
| 4,936,063 | 6/1990 | Humphrey | 52/200 |

*Primary Examiner*—Beth A. Stephan
*Assistant Examiner*—Dennis L. Dorsey
*Attorney, Agent, or Firm*—Renner, Otto, Boisselle & Sklar, LLP

[57] ABSTRACT

A roof structure for enclosures for swimming pools, spas, or patios and the like includes a plurality of laterally spaced angled roof beams each having a plurality of vertically spaced tracks on facing sides of adjacent beams for sliding receipt of one roof panel in each opposed set of tracks. The trailing ends of each higher panel is releasably latched to the leading end of each succeeding lower panel within their respective tracks, whereby the succeeding lower panels can be successively used to push or pull the preceding higher panels by hand along their respective tracks during assembly and removal of the panels from the roof structure.

24 Claims, 4 Drawing Sheets

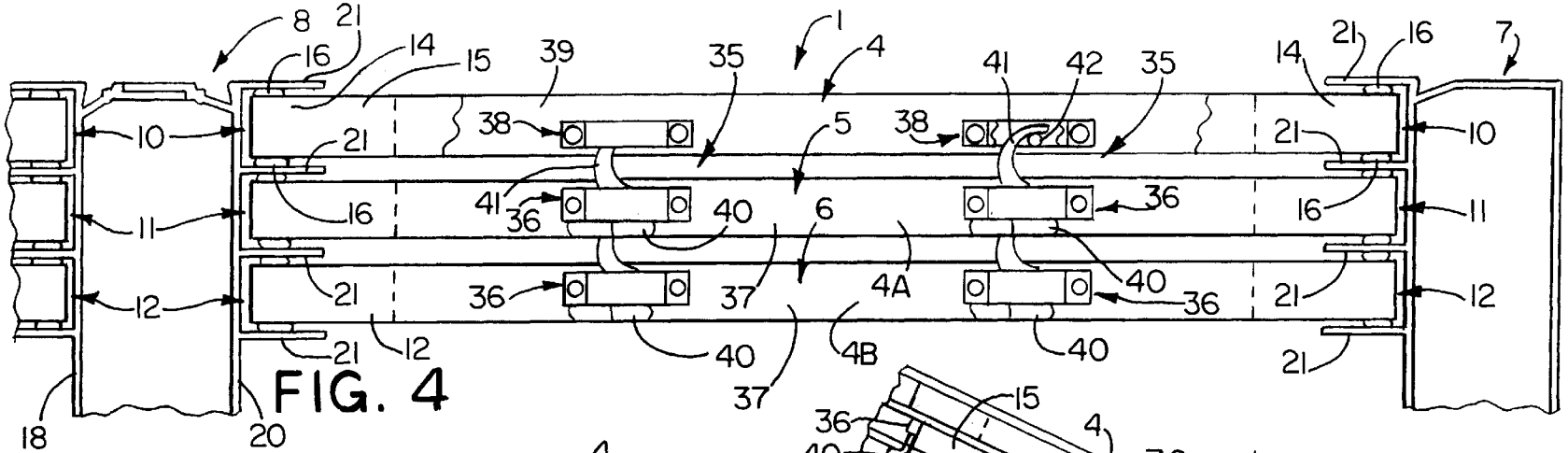
FIG. 4
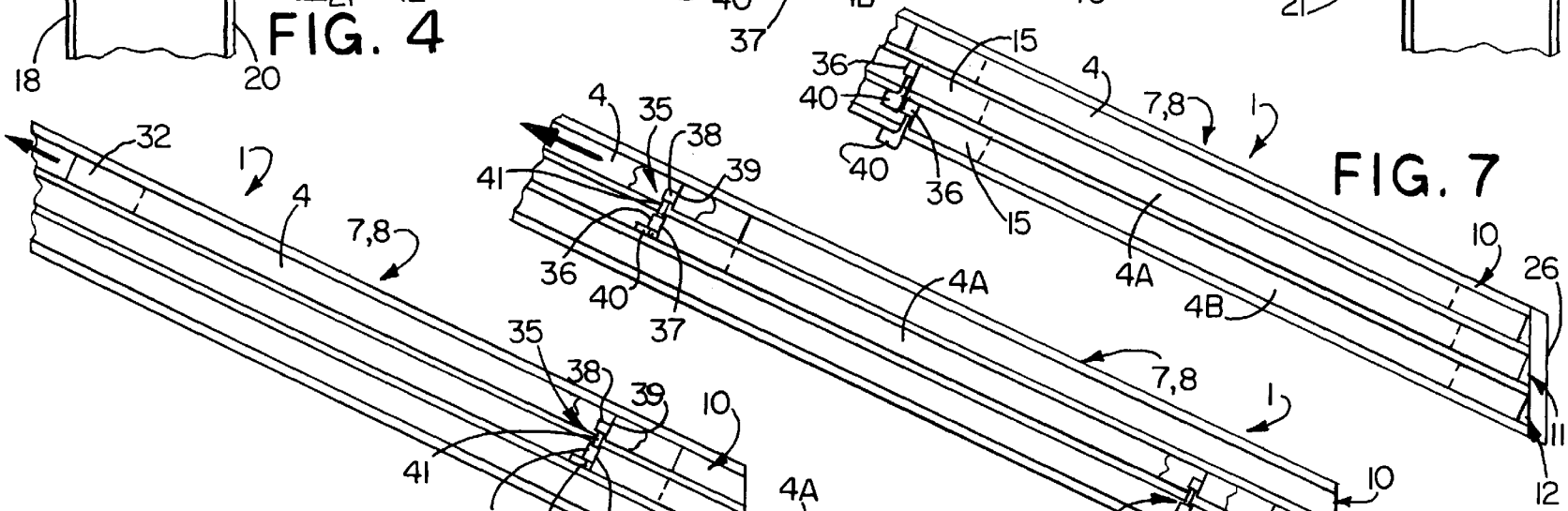
FIG. 7
FIG. 6
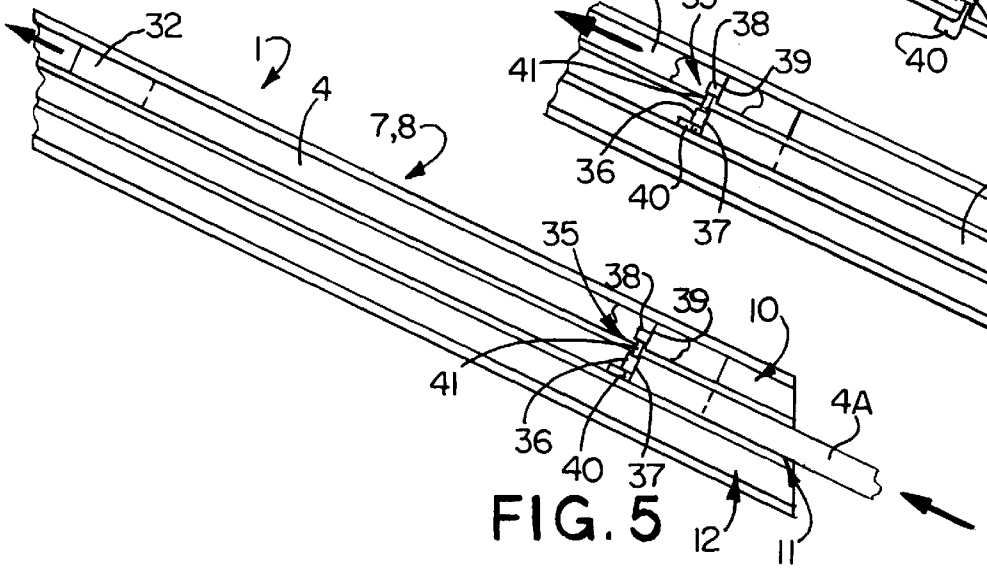
FIG. 5

ROOF STRUCTURE FOR ENCLOSURES FOR SWIMMING POOLS OR PATIOS AND THE LIKE HAVING REMOVABLE AND/OR STACKABLE ROOF PANELS

FIELD OF THE INVENTION

This invention relates to a roof structure for enclosures for swimming pools, spas, or patios and the like that is covered by a plurality of roof panels that may be selectively stacked in vertical alignment with each other adjacent a lower edge of the roof structure or completely removed from the roof structure altogether as desired.

BACKGROUND OF THE INVENTION

Swimming pools, spas, and patios and the like are commonly enclosed both for security reasons and to keep out insects, birds, animals and debris such as falling leaves.

In most cases screening is all that is used to cover the enclosures. However, in some cases the enclosures are at least partially covered by translucent or tinted glass or plastic materials to help keep out the weather and also provide some sun screening effect. Regardless of what covering material is used, the covering material is typically permanently installed on the roof structure as well as on the side wall structure. Having a permanently installed roof covering has the disadvantage that the roof covering cannot readily be removed in case of unusually high snow fall or high winds which could cause severe damage to the roof covering material and possible structural damage to the enclosure itself.

Providing such enclosures with removable roof panels is generally known. However, heretofore such removable roof panels have been difficult to install or remove, and the structure for accommodating such removable panels is typically quite expensive.

SUMMARY OF THE INVENTION

The roof structure for pool enclosures and the like of the present invention is adapted to be covered by roof panels that are easily stacked at the bottom edge of the roof structure or removed altogether in case of unusually high snow fall or high winds or for ease of cleaning, storage or shipping.

In accordance with one aspect of the invention, the roof structure is comprised of laterally spaced angled beams each having a plurality of vertically spaced, longitudinally extending tracks on facing sides of adjacent beams for sliding receipt of opposite side edges of the panels used to cover the roof structure.

In accordance with another aspect of the invention, a separate track is provided along the length of each beam for each panel so that all of the panels can readily be slid along their respective tracks for ease of installation and removal of the panels from the roof structure or for stacking of the panels in overlying relation with one another adjacent the bottom edge of the roof structure in case of unusually high snow fall or high winds.

In accordance with another aspect of the invention, the tracks on the beams are formed by vertically spaced, longitudinally extending fins integral with the facing sides of the beams.

In accordance with another aspect of the invention, a trailing end of each preceding higher panel is successively latched to a leading end of each succeeding lower panel in descending order of the height of the panels so that the succeeding lower panels can be successively used to push the preceding higher panels by hand into position along their respective tracks.

In accordance with another aspect of the invention, each succeeding lower panel is successively used to manually push each preceding higher panel upwardly along their respective tracks after such panels are successively latched together.

In accordance with another aspect of the invention, one or more of the roof beams are intermediate beams located between two other beams, the intermediate beams having a plurality of vertically spaced, longitudinally extending tracks on opposite sides thereof.

In accordance with another aspect of the invention, the roof structure includes ridge purlins extending between the upper ends of adjacent beams, the ridge purlins having a single side track in line with the uppermost tracks of the adjacent beams for sliding receipt of the leading end of the uppermost panel within the single side track when all of the panels are latched together end-to-end within their respective tracks.

In accordance with another aspect of the invention, the panels may be unlatched from each other beginning with the two lowermost panels to permit the panels to be successively pulled down their respective tracks and into vertical alignment with each other adjacent the lower ends of the tracks or removed from the tracks altogether as desired.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 4 is a fragmentary transverse section through the roof structure of FIG. 3 as seen from the plane of the line 4—4 thereof;

FIGS. 5 and 6 are schematic illustrations showing the steps of assembling the roof panels in their respective tracks in the roof structure of FIGS. 1 through 4;

FIG. 7 is a schematic illustration showing all of the roof panels stacked one above another adjacent a bottom edge of the roof structure.

DETAILED DESCRIPTION OF THE PREFERRED EMBODIMENT

Figure 1:
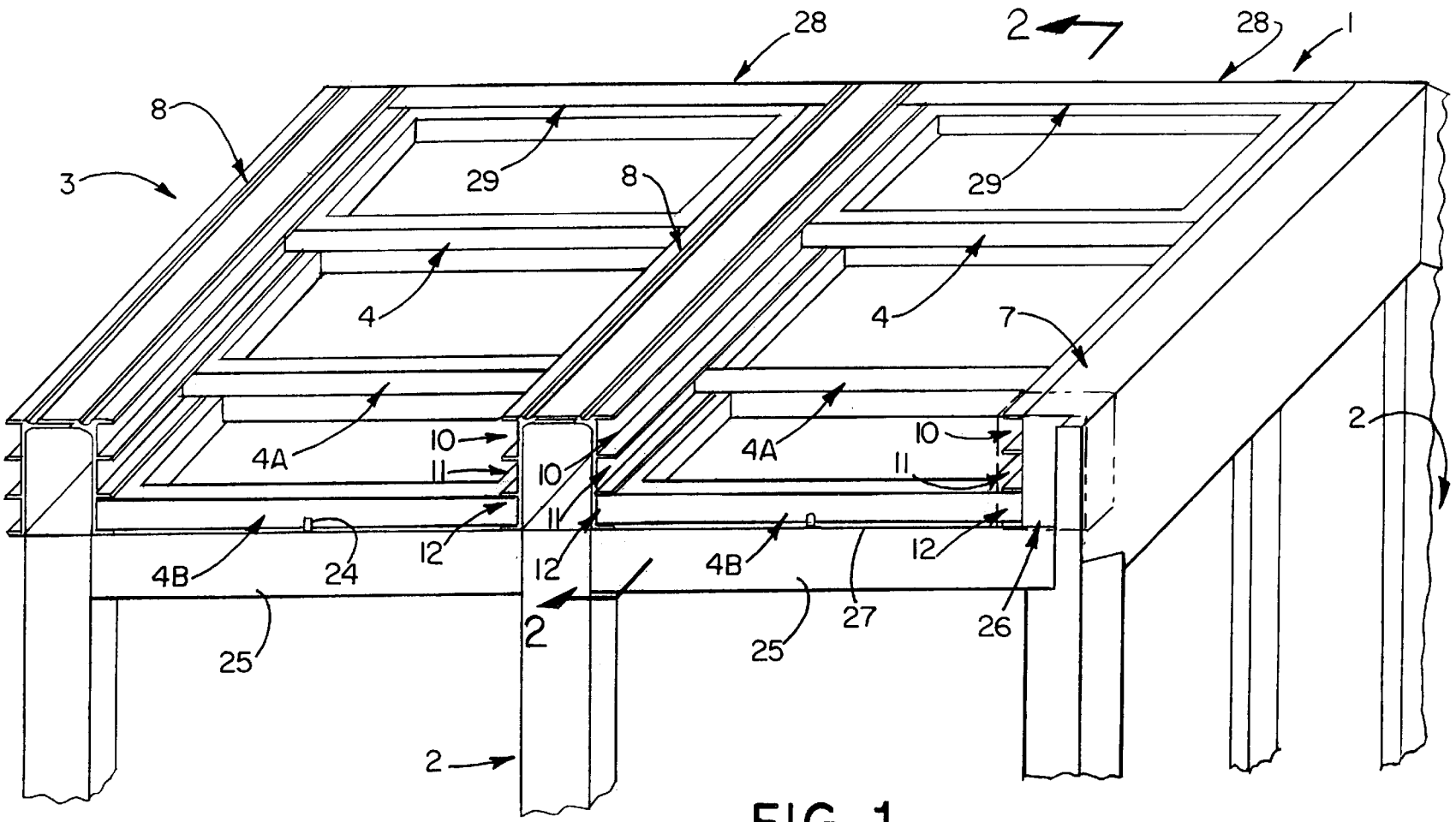
FIG. 1 is a fragmentary perspective schematic illustration of one form of roof structure for a pool or patio enclosure and the like in accordance with the present invention having three separate vertically spaced tracks on facing sides of adjacent roof beams for receipt of three roof panels used to cover each area of the roof structure between adjacent roof beams.

Referring now in detail to the drawings, and initially to FIG. 1, there is schematically shown a portion of a roof structure 1 in accordance with this invention and supporting side wall structure 2 of an enclosure 3 for a swimming pool or patio and the like constructed of various aluminum framing components. The particular roof structure shown is a gable roof. However, it will be appreciated that the roof structure may be one half of a gable if desired.

The side wall structure 2 may be permanently covered by a suitable covering material such as screen material that is rolled into spline grooves (not shown) in the uprights and purlins of the side wall structure in conventional manner. The roof structure 1, on the other hand, is covered by a plurality of easily removable panels 4, 4A, 4B, etc. of screen or translucent or tinted glass or plastic covering material 5 (shown in FIG. 3) for ease of installation and removal of the panels in case of unusually high snow fall or high winds or for cleaning, storing or shipping of the panels as described hereafter. To that end, the facing sides of the end and intermediate angled roof beams 7 and 8 that comprise the primary support members for the roof structure 1 have a plurality of vertically spaced, longitudinally extending tracks 10 through 12 for sliding receipt of opposite side edges 14 of the panel frames 15 in the tracks as shown in FIG. 4. Extending completely around opposite sides of the panel frames 15 is weatherstripping 16 that supports the panel frames 15 for sliding movement along the tracks and also provides a close sliding seal therebetween.

Referring further to FIG. 4, the end beams 7 have tracks 10 through 12 on one side only, whereas the intermediate beams 8 have tracks 10 through 12 on both sides thereof. Also, the end beams 7 are typically hollow aluminum extrusions whereas the intermediate beams 8 are typically snap extrusions or self mating beams comprised of two aluminum extrusions 18, 20 mated together. In either case, the tracks 10 through 12 for the panels are formed by a plurality of vertically spaced, longitudinally extending fins 21 integral with the facing sides of the beams. Moreover, each track 10 through 12 is formed by two adjacent fins 21 and each adjacent track shares one of the fins so that the tracks are closely spaced from each other.

Although the dimensions of the tracks may vary within certain limits, in the preferred embodiment disclosed herein, the fins 21 have a wall thickness of approximately 0.055 inch thus providing a spacing between tracks of approximately 0.055 inch. Also, each track has a height of approximately 1.00 inch and a width of approximately 0.875 inch.

Figure 8:
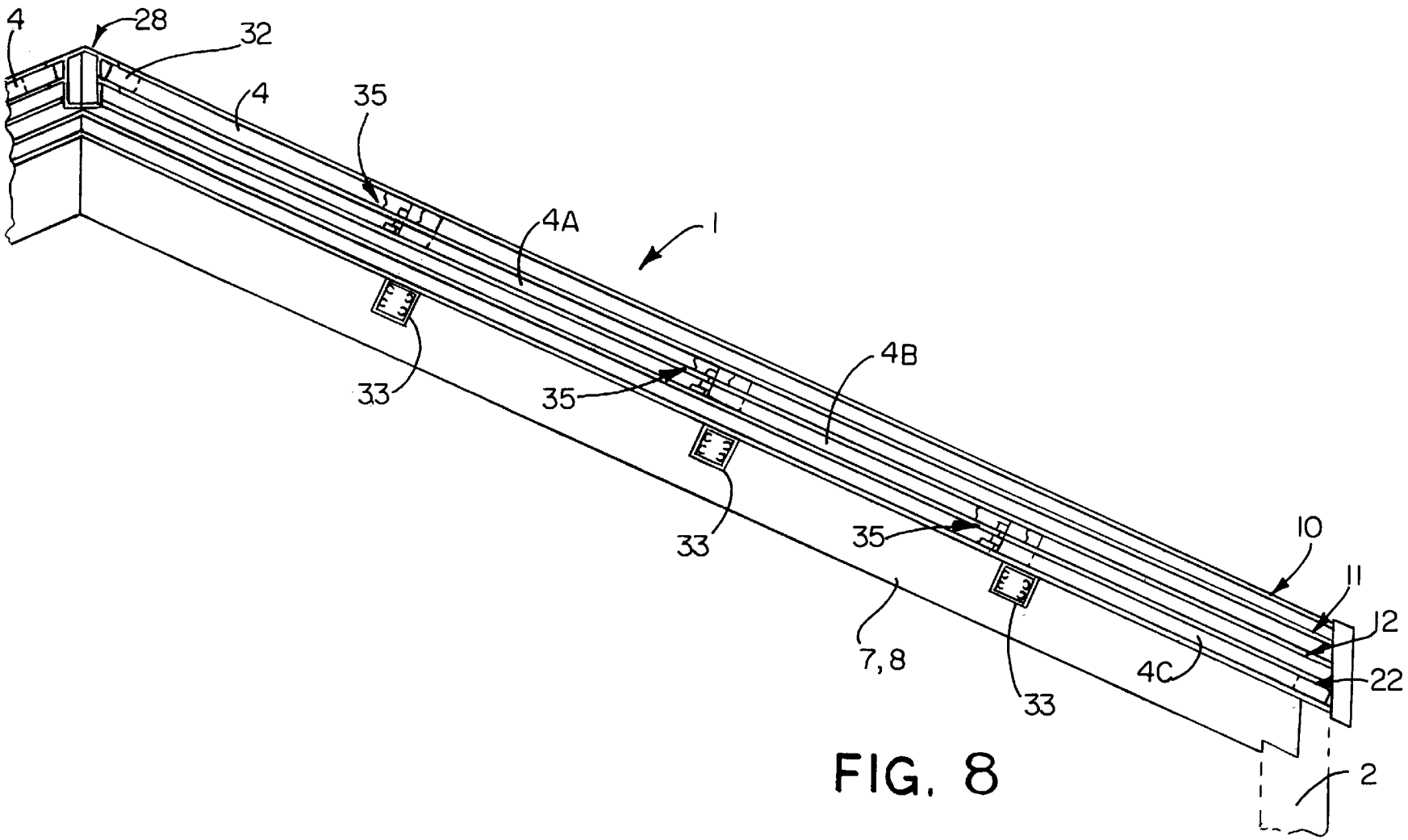
FIG. 8 is a fragmentary longitudinal section of a modified form of roof structure in accordance with the present invention which is substantially the same as the roof structure shown in FIGS. 1–7 except that four separate vertically spaced tracks are provided on facing sides of adjacent roof beams containing four slidable roof panels for covering each area of the roof structure between adjacent roof beams.

The width of the panels 4 will of course vary depending on the lateral spacing between adjacent beams. Also, the number of tracks 10 through 12 will vary depending on the number of panels required to cover each area of the roof structure between adjacent beams, there being one set of tracks between adjacent beams for each panel. In the embodiment shown in FIGS. 1 through 7, three vertically spaced tracks 10 through 12 are provided on the facing sides of adjacent beams for sliding receipt of three panels 4, 4A and 4B therebetween, one panel in each set of tracks, whereas in the embodiment shown in FIG. 8 four such vertically spaced tracks 10 through 12 and 22 are provided between adjacent beams for receipt of four panels 4, 4A, 4B and 4C therebetween. Otherwise, the details of construction of the roof structure shown in FIG. 8 are substantially identical to the roof structure shown in the other drawing figures, and the same reference numerals are used to designate like parts.

Figure 2:
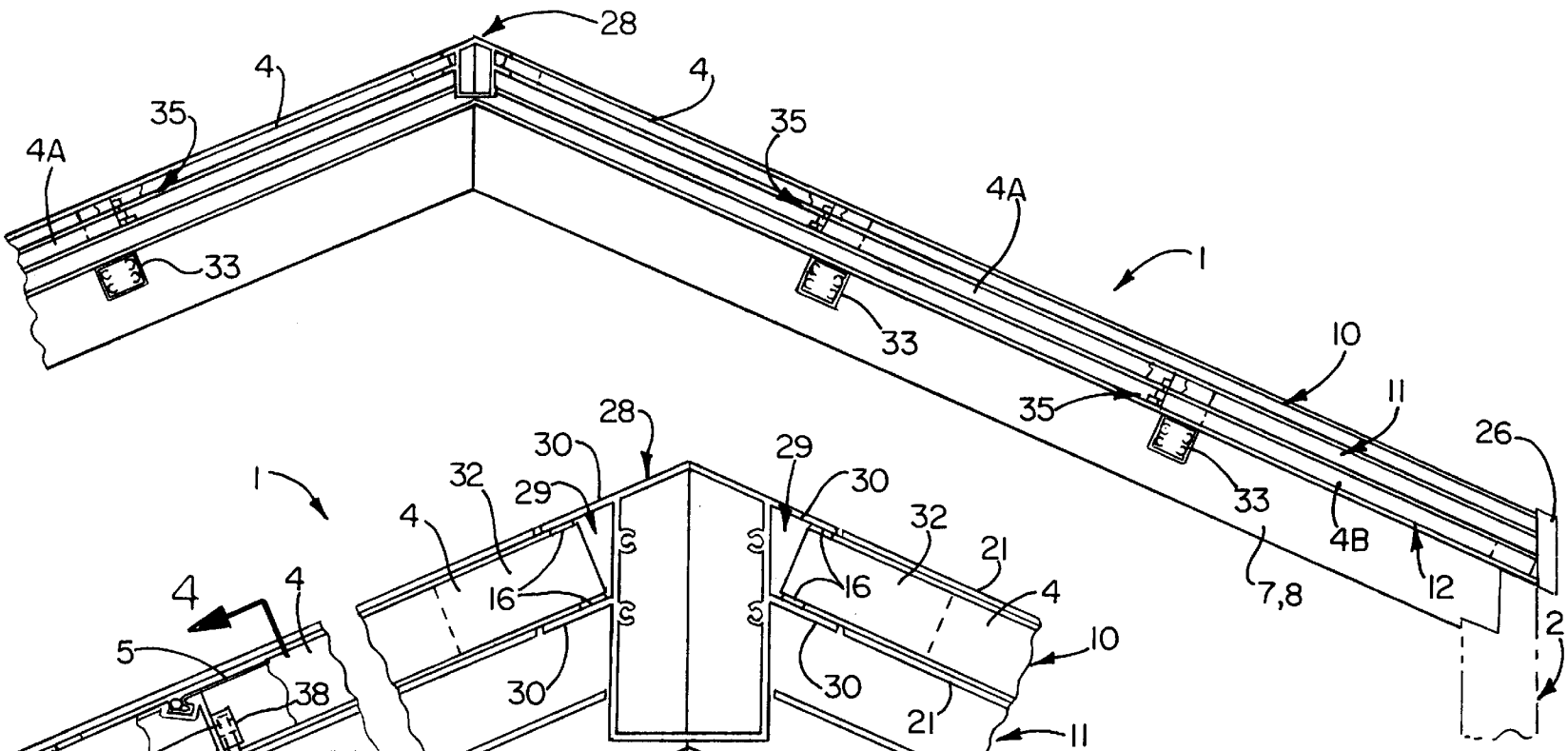
FIG. 2 is a fragmentary longitudinal section through the roof structure of FIG. 1 as seen from the plane of the line 2—2 thereof.
Figure 3:
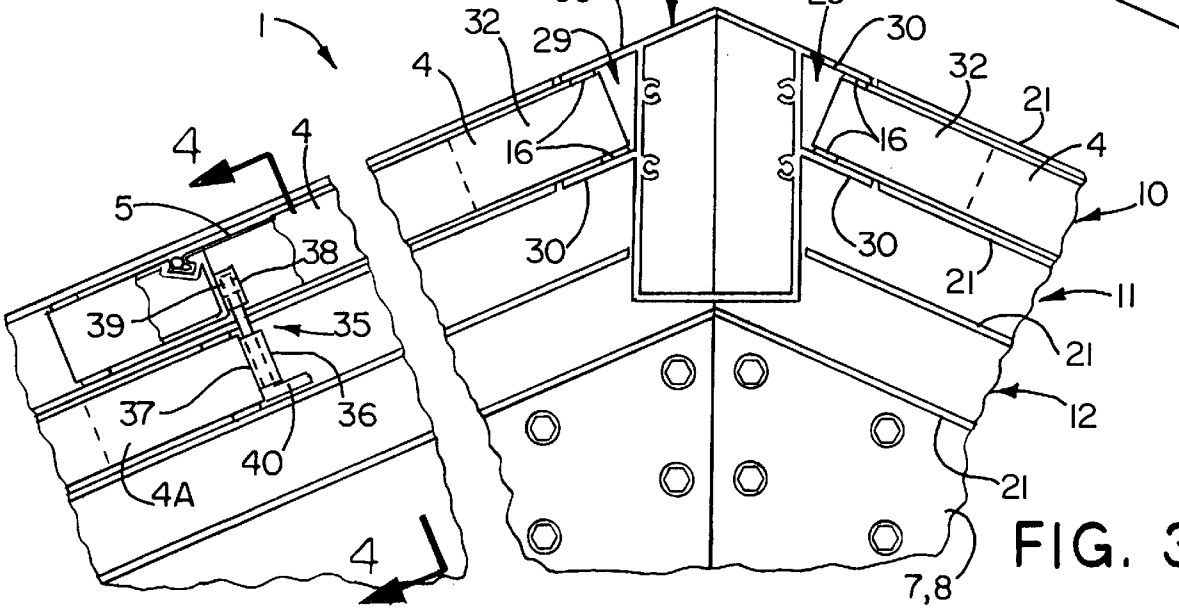
FIG. 3 is an enlargement of a portion of the roof structure of FIG. 2.

Removable pins 24 (schematically shown in FIG. 1) may be provided in the bottom rail or corner beam 25 extending between the outer ends of adjacent beams 7, 8 to prevent inadvertent removal of the bottommost panel from its respective track 12. Alternatively, angled caps 26 may be removably attached to the outer ends of the beams 7, 8 as schematically shown in FIGS. 1 and 2 to prevent inadvertent removal of any of the panels from their respective tracks. To remove the panels from their respective tracks (or to insert the panels into their respective tracks), the pins 24 and/or angled caps 26 must first be removed from the roof structure. The upper surface 27 of the bottom rail 25 slopes upwardly at the same angle as the lowermost tracks 12 of the adjacent beams immediately beneath the bottom fins 21 of the lowermost tracks as schematically shown in FIG. 1.

Where the roof structure 1 is a gable roof structure, two sets of laterally spaced angled beams 7, 8 are connected together in conventional manner at their upper ends as schematically shown in FIGS. 1 through 3. Extending between the upper ends of adjacent beams 7, 8 are ridge purlins 28 which, like the top rails 25, transfer loads and maintain spacing between adjacent beams. As best seen in FIG. 3, on each side of the ridge purlins 28 is a single side track 29 formed by a pair of angled fins 30 integral with each side. The fins 30 extend the full length of the ridge purlins 28 in line with the fins 21 of the uppermost tracks 10 of the adjacent beams 7, 8 for sliding receipt of the leading end 32 of the uppermost panel 4 when all of the panels are inserted into their respective tracks and latched together end-to-end as described hereafter. Portions of the fins 21 on the beams 7, 8 are cut away as needed to accommodate the ridge purlins while maintaining as close a spacing as practical therebetween.

In the embodiment disclosed herein, the ridge purlin fins 30, like the main roof support beam fins 21, have a wall thickness of approximately 0.55 inch. Also, the ridge purlin fins 30 extend outwardly from the sides of the ridge purlins approximately 0.875 inch, and form side tracks 29 having a height of approximately 1.00 inch (which corresponds to the height of the main support beam tracks 10 through 12). Additional purlins 33 are also provided between adjacent beams 7, 8 vertically below the bottommost track 12 (or 22) to transfer loads and maintain spacing between adjacent beams.

During assembly, the panels 4, 4A, 4B, etc. are successively inserted into their respective tracks 10 through 12 (and 22) in the descending order of height of the tracks. As each successive panel is inserted into its respective track (while the pins 24 and/or angled caps 26 are removed from the roof structure), the leading end of each successive panel is latched to the trailing end of the previously inserted panel and the successive panels are used to manually push the previously inserted panels upwardly along their respective tracks as schematically shown in FIGS. 5 and 6. The particular latch mechanism 35 disclosed herein for latching the ends of successive panels together is shown in FIGS. 3 and 4 as comprising one or more male latch members 36 mounted on the outside walls 37 of the leading ends of the second and each subsequent panel 4A, 4B, etc. (from top to bottom) inwardly of their respective tracks engaging female latch members 38 correspondingly located on the inside walls 39 of the trailing ends of the first and each subsequent panel 4, 4A, 4B, etc. (from top to bottom).

Whenever there is a threat of high winds or unusually high snow fall, the panels 4, 4A, 4B, etc. can be successively unlatched from each other beginning with the two lowermost panels (e.g., panels 4B and 4A if three panels are used to cover each roof area between adjacent beams or panels 4C and 4B if four panels are used to cover each such roof area). As the panels are successively unlatched, the next successive higher panel is pulled down along its respective set of tracks by hand from the bottom and is stacked in overlying relation with the adjacent lower panel adjacent the lower ends of the respective tracks as schematically shown in FIG. 7. Alternatively the panels may be successively removed from their respective tracks altogether upon removing the pins 24 or angled caps 26 from the lower ends of the roof structure. The panels are unlatched from each other simply by pulling down on the handles 40 of the male latch members 36 to retract the hook portions 41 of the male latch members out of engagement with the internal pins 42 of the female latch members 38 (see FIG. 4). When the hook portions 41 are retracted, the handles 40 of the male latch members 36 will extend downwardly below their respective panel frame members 15 as schematically shown in FIG. 7. To latch the panels together, the male latch members 36 on the panels 4A and 4B are brought into alignment with the female latch members 38 in the respective panels 4 and 4A and the handles 40 are pushed upwardly to engage the hook portions 41 with the pins 42 as shown in FIG. 4.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A roof structure for enclosures for swimming pools, spas and patios comprising a plurality of laterally spaced angled roof beams each having a plurality of vertically spaced, longitudinally extending tracks on facing sides of adjacent beams, a plurality of vertically spaced panels having opposite side edges slidably received in said tracks in said adjacent beams, and latch means for releasably latching a trailing end of each higher panel to a leading end of each adjacent lower panel within their respective tracks to hold said panels end-to-end within their respective tracks.

2. The roof structure of claim 1 wherein said latch means comprises one or more male latch members mounted on outside walls of leading ends of the second and each subsequent panel in descending order of the height of said panels within their respective tracks and a corresponding number of female latch members mounted on inside walls of trailing ends of the first and each subsequent panel in descending order of the height of said panels within their respective tracks.

3. The roof structure of claim 2 wherein said male latch members include handle means accessible from below said panels within their respective tracks for moving hook portions of said male latch members into and out of latching engagement with said female latch members.

4. The roof structure of claim 1 wherein the number and length of said panels when latched together end-to-end within their respective tracks are sufficient to cover said roof structure between said adjacent beams.

5. The roof structure of claim 1 wherein all of said tracks extend the full length of each of said beams.

6. The roof structure of claim 1 wherein said tracks are formed by plural pairs of vertically spaced, longitudinally extending fins integral with said facing sides of said beams.

7. The roof structure of claim 6 wherein said fins extend substantially the full length of said beams.

8. The roof structure of claim 7 wherein there are four of said fins on each of said facing sides of said beams providing three said tracks along said facing sides of said beams for sliding receipt of three said panels along said tracks.

9. The roof structure of claim 7 wherein there are five of said fins on each of said facing sides of said beams providing four of said tracks along said facing sides of said beams for sliding receipt of four said panels along said tracks.

10. The roof structure of claim 1 wherein at least one of said beams is an intermediate beam located between two other beams, said intermediate beam having a plurality of vertically spaced, longitudinally extending tracks on both sides of said intermediate beam.

11. The roof structure of claim 10 wherein said intermediate beam is comprised of two extruded sections mated together.

12. The roof structure of claim 1 which has a pitch corresponding to the angle of said beams, said tracks extending at the same angle as said beams.

13. The roof structure of claim 12 further comprising ridge purlins extending between upper ends of said adjacent beams to transfer loads and maintain spacing between said adjacent beams, said ridge purlins having a single side track extending the full length of said ridge purlins in line with the uppermost tracks of said adjacent beams for sliding receipt of a leading end of the uppermost panel within said single side track when all of said panels are latched together end-to-end.

14. The roof structure of claim 13 which is a gable roof structure having two sets of said laterally spaced angled beams connected together at their upper ends, and said ridge purlins have a single side track extending the full length of both sides of said ridge purlins in line with the uppermost tracks of said adjacent beams on opposite sides of said gable roof structure for sliding receipt of the leading ends of the uppermost panels within said single side tracks when all of said panels are latched together end-to-end.

15. The roof structure of claim 1 wherein said panels when unlatched from each other, are free to be slid down their respective tracks into vertical alignment with each other adjacent lower ends of said tracks.

16. The roof structure of claim 1 further comprising end wall top members extending between lower ends of said adjacent beams to transfer loads and maintain spacing between said adjacent beams, said end wall top members having an upper surface that slopes upwardly at the same angle as the lowermost tracks of said adjacent beams immediately beneath said lowermost tracks.

17. The roof structure of claim 1 further comprising stop means for preventing inadvertent removal of the lowermost panel from its respective track.

18. The roof structure of claim 17 wherein said stop means comprises a removable pin extending upwardly from top rails extending between lower ends of said adjacent beams which when removed permits said panels to be slid down and out of their respective tracks for completely removing said panels from their respective tracks.

19. The roof structure of claim 1 further comprising removable cap means covering outer ends of said adjacent beams for preventing inadvertent removal of said panels from their respective tracks, said cap means when removed permits said panels to be slid down and out of their respective tracks for completely removing said panels from their respective tracks.

20. The roof structure of claim 1 further comprising weather-stripping extending outwardly from opposite sides of said panels around the entire periphery of said panels for supporting said panels for sliding movement along said tracks.

21. The roof structure of claim 1 further comprising a plurality of spaced apart purlins extending between said adjacent beams below said tracks to transfer loads and maintain spacing between said adjacent beams.

22. A method of covering a roof structure of a pool, spa, or patio enclosure with a plurality of panels wherein the roof structure includes a plurality of laterally spaced angled beams each having a plurality of vertically spaced, longitudinally extending tracks on facing sides of adjacent beams, comprising the steps of successively inserting panels into the tracks in descending order of height of the tracks, successively latching a leading end of each succeeding lower panel to a trailing end of each preceding higher panel to hold the panels end-to-end within their respective tracks, and sliding each succeeding lower panel upward along its track to push each preceding higher panel upward along its track prior to latching the leading end of the next succeeding lower panel to the trailing end of the next preceding higher panel.

23. The method of claim 22 further comprising the steps of successively unlatching the leading end of each succeeding lower panel from the trailing end of each preceding higher panel in order of ascending height of the panels in their respective tracks, and before unlatching the next succeeding lower panel from the next preceding higher panel, sliding each preceding higher panel downward along its track into overlying relation with the next succeeding lower panel to stack the panels in vertical alignment with each other adjacent lower ends of the tracks.

24. The method of claim 22 further comprising the steps of successively unlatching the leading end of each succeeding lower panel from the trailing end of each preceding higher panel in order of ascending height of the panels, and before unlatching the next succeeding lower panel from the next preceding higher panel, removing the previous lowermost panel from its track, and sliding each preceding higher panel down along its respective track.

* * * * *